US006095607A

United States Patent [19]

Wenzel

[11] Patent Number: 6,095,607

[45] Date of Patent: Aug. 1, 2000

[54] UNIVERSAL ADJUSTABLE CHAIR

[76] Inventor: William B. Wenzel, 17749 Columbia Dr., Castro Valley, Calif. 94552

[21] Appl. No.: 09/324,786

[22] Filed: Jun. 4, 1999

[51] Int. Cl.[7] ..... A47C 1/14

[52] U.S. Cl. ..... 297/344.18; 297/16.1; 297/118; 297/130

[58] Field of Search ..... 297/16.1, 17, 35, 297/344.12, 344.18, 130, 118, 129, 29

[56] References Cited

U.S. PATENT DOCUMENTS

| | | | |
|---|---|---|---|
| 4,772,068 | 9/1988 | Gleckler . | |
| 4,848,197 | 7/1989 | Sansing | 297/344.18 |
| 4,889,383 | 12/1989 | Jones | 297/17 |
| 5,335,377 | 8/1994 | Masyada . | |
| 5,364,163 | 11/1994 | Hardison . | |
| 5,449,220 | 9/1995 | Taylor et al. | 297/16.1 |
| 5,494,333 | 2/1996 | Wilson . | |

*Primary Examiner*—Anthony D. Barfield
*Attorney, Agent, or Firm*—Thomas M. Freiburger

[57] ABSTRACT

An adjustable-leg chair has four telescoping legs with provision for setting each leg at a desired length. The chair adjusts to very uneven terrain so that the user can sit in a generally level and comfortable position especially for fishing on the bank of a river or lake, uneven camp sites, graded spectator seating locations, etc. The folding aluminum chair has horizontal connecting braces extending across front and back at the bottom ends of upper leg sections which comprise tubes of the telescoping connection. When the lower extensions of the telescoping legs are fully removed, the chair serves as a beach chair with the connecting braces being the primary contacts with the sand or ground.

6 Claims, 3 Drawing Sheets

FIG. 3
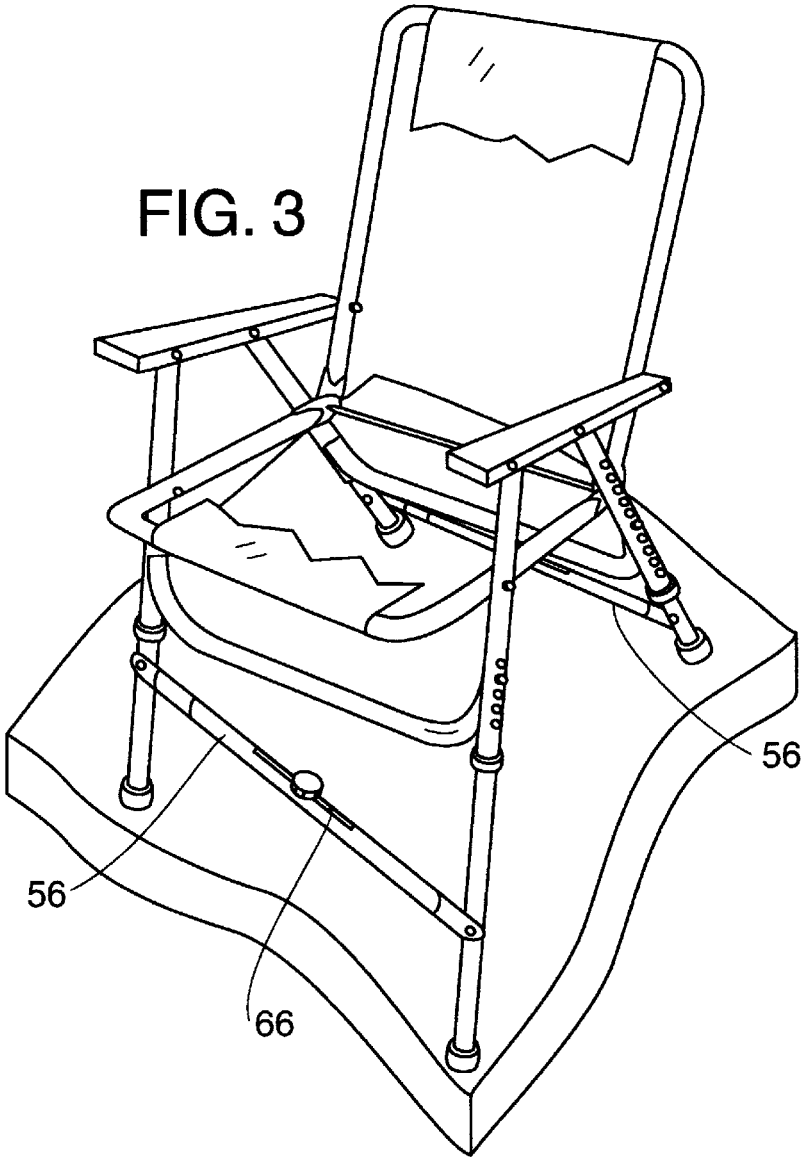
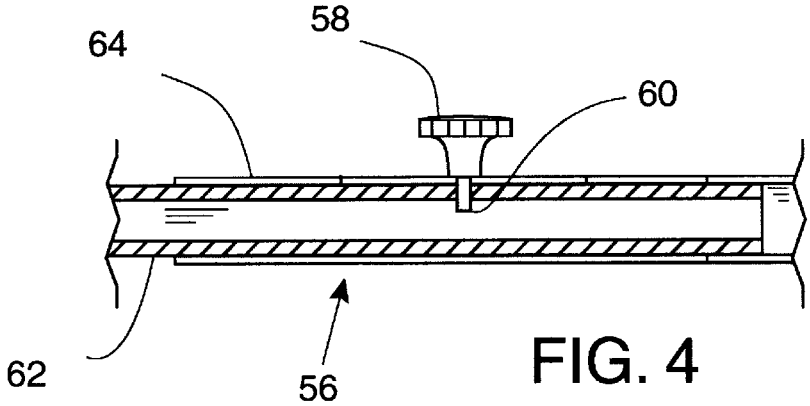
FIG. 4

UNIVERSAL ADJUSTABLE CHAIR

BACKGROUND OF THE INVENTION

This invention concerns a chair, and particularly a chair with four adjustable-length legs for positioning on uneven ground, and a chair which serves also as a low beach chair.

Chairs with adjustable-length legs are known. For example, Wilson U.S Pat. No. 5,494,333 describes a folding chair for uneven terrain with three adjustable legs and leveling feet. Gleckler U.S. Pat. No. 4,772,068 shows a chair with U-shaped front and back leg members, similar to a beach chair, but with the leg members telescoping and adjustable as to length of extension down from the seat. That chair adjusts to uneven terrain in the forward and back direction, but not side to side.

Hardison U.S. Pat. No. 5,364,163 discloses another example of a chair with adjustable-length legs, again U-shaped telescoping leg members as in the Gleckler patent. The leg members lock in position using spring-biased locking pins which engage in holes of the telescoping leg members.

Other chairs, particularly for medical use, have included four individually adjustable legs, also using locking pins engagable in the holes of the telescoping lower leg portions. For example, see Masyada U.S. Pat. No. 5,335,377, designed particularly for use in a bath by handicapped individuals. However, nothing in the prior art provided or contemplated a foldable lightweight chair useful for riverbank fishing or other activities on very uneven terrain, while also being useful as a low-level beach chair. These are features and advantages of the invention as described below.

SUMMARY OF THE INVENTION

The adjustable fishing chair and beach chair of the invention has a lightweight folding frame of aluminum tubing of essentially conventional basic configuration. A frame comprising a seat frame and back frame each formed of aluminum tubing and pivoted together has connected to it a pair of arms and left and right pairs of upper leg sections which pivot from the arms and seat frame. This arrangement, conventional as thus far described, folds about the pivot joints into a generally flat configuration with the seat up against the back and the legs and arms essentially all parallel.

In the adjustable folding chair of the invention, a pair of connecting braces extend laterally across the chair at front and back, secured at bottom ends of the tubular upper leg sections. These lateral, horizontal connecting braces are at a level such that the chair as thus far described serves as a folding beach chair, with the seat low to the ground or sand, only about 7 to 9 inches above the sand.

However, each of the upper leg sections is tubular and hollow, with an open bottom end. Thus, each of the four leg sections can receive a lower leg extension in telescoping fashion, with each of these lower extensions being individually adjustable to an appropriate extending length. A locking device such as a spring-biased pin in each leg extension, cooperative with a series of holes in each of the tubular upper leg sections, provides for accommodating the chair to virtually any uneven terrain.

Thus, in one preferred form an adjustable-leg chair for fishing and for beach or lawn use comprises a chair frame with a seat and back, and left and right arms secured to the back. The chair further includes four upper leg sections, two secured to the left arm and two to the right arm in pivot connections allowing for folding of the chair. The upper leg sections are tubular. At front and back of the chair are connecting braces extending laterally and rigidly connected to the legs at left and right, near the bottom ends of those legs. Cooperative with the upper leg sections are four lower leg extensions, one telescopically fitted into each of the upper leg sections with means for adjusting the position of each of the leg extensions within the upper leg section and for locking each leg extension at a selected position relative to the upper leg section. In this way the extending length of each lower leg section is individually adjustable to adjust the chair to a generally level and comfortable position on virtually any uneven terrain. In addition, the lower leg extensions are fully releasable via the adjusting and locking means, to completely remove all four legs from the chair and thus to form a low-level beach or lawn chair with the front and rear connecting braces serving as supports against the beach or ground.

An object of the invention is to provide a versatile combination beach, camping, and fishing chair as described, with simple and quick adjustability. These and other objects, advantages and features of the invention will be apparent from the following description of preferred embodiments, considered along with the accompanying drawings.

DESCRIPTION OF THE DRAWINGS

FIG. 3 is a perspective view showing the chair as used on uneven terrain, with the four legs adjusted to varying heights, and with braces which may be included.

FIG. 4 is a detail view in section to show function of one of the braces as it appears in FIG. 4.

DESCRIPTION OF PREFERRED EMBODIMENTS

Figure 1:
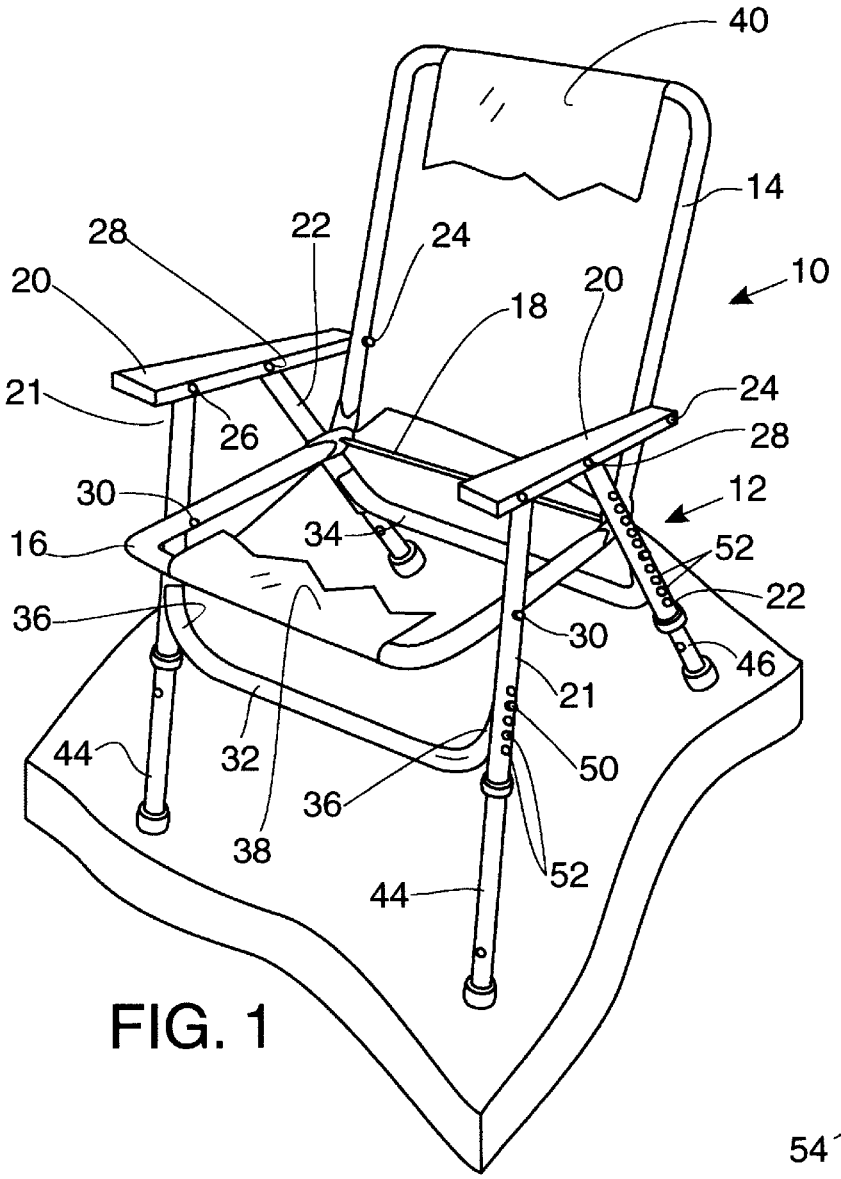
FIG. 1 is a perspective view showing an adjustable chair according to the invention.

FIG. 1 shows an embodiment of the adjustable chair 10 of the invention, which includes a frame 12 comprising a back frame 14 and a seat frame 16, pivoted together at bottom and rear as by a pivot rod 18 passing through ends of the two frame components 14 and 16, preferably each of the frame components 14 and 16 is U-shaped. To this chair frame 12 are connected left and right arms 20, which are connected to two front upper leg sections 21 and two rear upper leg sections 22. All of these connections are pivot connections, as at 24, 26 and 28, and in addition, the front upper leg sections 21 are pivotally connected to the chair frame 16 at pivots 30. The chair 10 holds up in a conventional manner, by lifting the two arms upwardly on their pivots 24, alongside the back frame 14, which brings the front legs, back legs and seat into a compact configuration. In the erected position as shown, the chair frame 12 is held in position against the rear leg sections 22 by resting against those leg sections, preferably by extensions of the pivot rod, which bear against back surfaces of those leg sections 22.

The chair 10 of the invention has front and rear connecting braces 32 and 34, preferably slightly U-shaped as shown, with upwardly turned left and right ends 36. Those ends 36 are welded or otherwise secured to the upper leg sections 21 and 22, near their lower ends. In a preferred embodiment the braces 32 and 34 are at a level on the chair slightly lower than the bottom ends of the upper leg sections 21 and 22.

An appropriate form of fabric or plastic seat and back 38 and 40 are secured to the seat and back frame components 14 and 16. These seat and back support materials are secured in a conventional manner.

Figure 5:
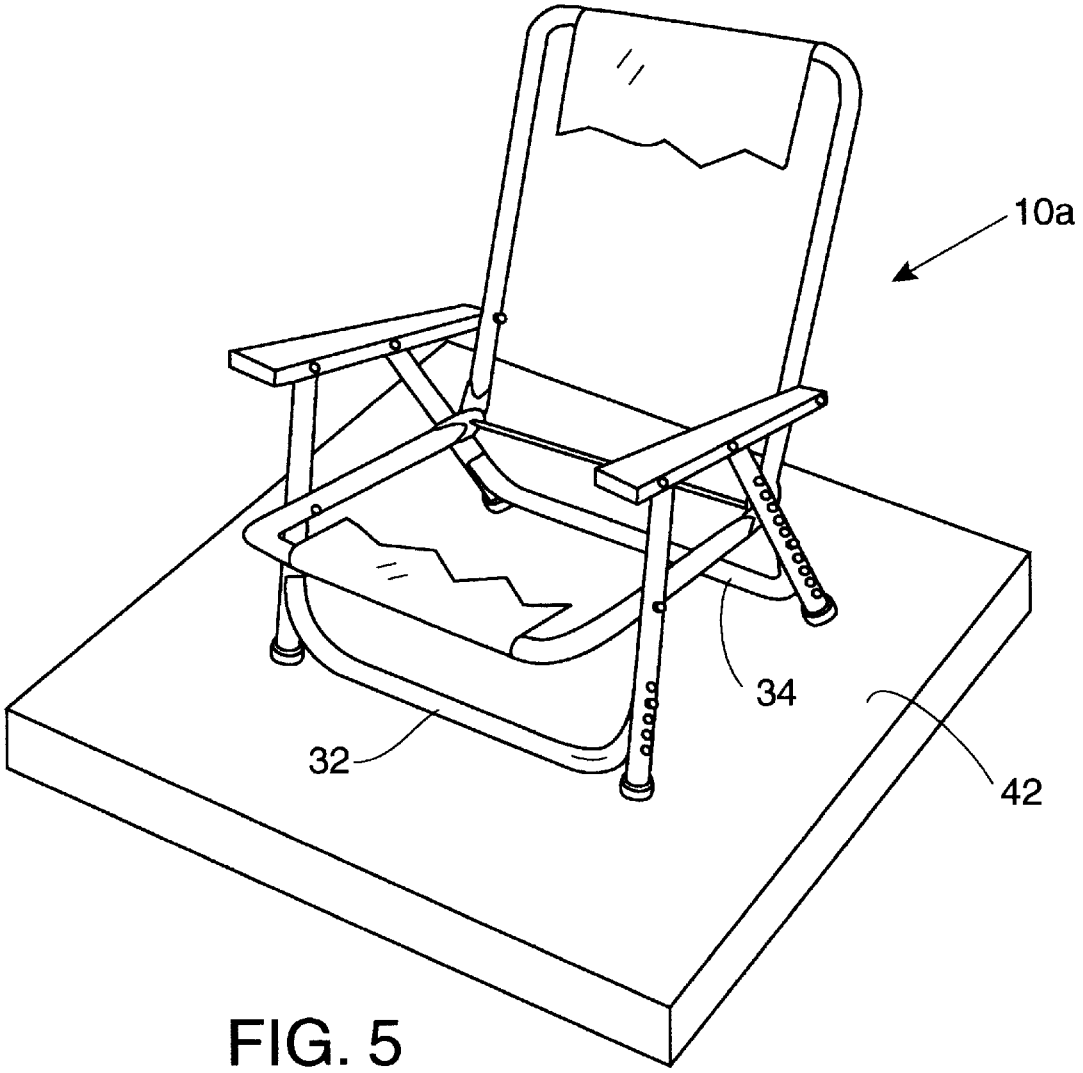
FIG. 5 is a view showing the chair in use without leg extensions, as a low-level beach chair.

As thus far described, the chair is seen in FIG. 5 as a beach chair or lawn chair for sitting at a low level. The chair 10*a* in FIG. 5 is without leg extensions and sits approximately 6 to 10 inches above the ground or beach sand. The leg braces 32 and 34, being the main supporting elements for the chair and preferably lowermost on the chair, thus provide a stable means of support for the chair on ground or beach sand 42, whereas four individual legs extending into sand or soft ground would be less advantageous.

The chair 10 as shown in FIG. 1 has four lower leg extensions, including front leg extensions 44 and rear leg extensions 46. These leg extensions are adjustable as to position within the upper leg sections, so that they can be made to extend to various lengths down from the upper legs. The lower leg extensions are telescopically fitted together with the upper leg sections as seen in the drawings, thus allowing telescoping adjustment, and locking of the legs is preferably effected by means of spring pins or nipples 50 which are biased outwardly from the lower leg extensions positioned to pop into a selected one of a series of holes 52 in the upper leg sections, as shown.

Figure 2:
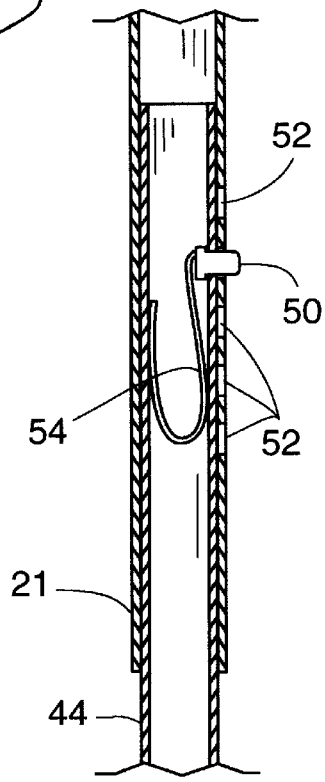
FIG. 2 is a detail view in section showing a part of a telescoping adjustable leg of the chair.

This locking device is better seen in the sectional view of FIG. 2, showing a tubular lower leg extension 44 fitted inside the larger-diameter tubular upper leg section 21. Inside the leg extension 44 is a leaf type spring 54, secured to the pin or nipple 50 so as to be constantly urging the pin outwardly through an opening in the wall of the inner tubular leg extension 44. The locking pins 50 can be operated by a finger or a thumb, pushing them inward sufficiently to allow up/down sliding movement of the inner leg 44 within the outer leg section 21, until a desired position is reached in which the leg is extended as needed to accommodate uneven ground. Each leg may thus be adjusted differently, to accommodate the stability and comfort of the user on uneven ground, both forward/back and left/right.

FIGS. 3 and 4 show the chair 10 fitted with lateral braces 56. The lower leg extensions 44, 46 are at varying degrees of extension of the chair, shown on uneven ground, and one leg 44 is at a considerable extension. If the chair frame and leg components are made of particularly lightweight tubing for lightness in transport, these braces 56 can be helpful in improving stability of the chair on very uneven terrain, particularly when one of the legs is subjected to long extension. These lateral braces can be connected to the lower leg extensions by rivets which allow pivoting, or by bolt and nut connections. The length of each lateral brace is adjustable as shown in both FIGS. 3 and 4, by telescoping arrangement as illustrated, with an appropriate of locking means such as the knob 58 and machine thread 60 shown, threadably engaged in the wall of the inner is tubular piece 62 and positioned so that the knob can lock down against the outer tubular piece 64, by engaging both sides of a slotted opening 66.

Alternate forms of leg braces could be used. These could include two front to rear braces, each extending from a front leg to a rear leg.

Although the chair 10 of the invention employs several known concepts and elements of hardware in a folding chair, the chair is unique and very advantageously used for multiple purposes as described above. With its leg extensions it is used as a camping or fishing chair on very uneven ground, with each leg individually adjustable, and with the leg extensions removed it can be used as in FIG. 5, as a low level beach or lawn chair. The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A foldable, adjustable-leg chair for fishing or camping and for beach or lawn use, comprising:

a chair frame comprising a seat and back pivotally connected together, left and right arms pivotally connected to the back, four upper leg sections, including two front upper leg sections and two rear upper leg sections, the leg sections having upper ends pivotally connected to the left arm and the right arm, the front leg sections also being pivotally connected to the chair frame at the seat, a front connecting brace at the front of the chair, extending laterally and generally horizontally and being rigidly connected to the front upper leg sections, near bottom ends of the front upper leg sections, a rear connecting brace at the rear of the chair, extending laterally and generally horizontally and rigidly secured to the rear upper leg sections, near lower ends of the rear upper leg sections, the four upper leg sections being tubular and open from their bottom ends, four lower leg extensions, one telescopically fitted together with each of the upper leg sections with means for adjusting the position of each of the four lower leg extensions within the upper leg section and for locking the lower leg extension at a selected position, to thus individually set the extending length of each of the four lower leg extensions so that the chair can be put at a generally level and comfortable position on virtually any uneven terrain, and the lower leg extensions being fully releasable via said adjusting and locking means, to completely remove all four legs from the upper leg sections, thus forming a beach or lawn chair with the front and rear connecting braces serving as supports for the chair against the beach or ground.

2. A chair according to claim 1, wherein the connecting braces extend to a level below the lower ends of the upper leg sections, so that when the lower leg extensions are omitted from the chair, primary contact with the beach or ground is made via the generally horizontal connecting braces.

3. A chair according to claim 2, wherein the connecting braces each have left and right ends which curve upwardly into the rigid connection with the respective upper leg section.

4. The chair of claim 1, wherein the locking means between the telescoping lower leg extensions and the upper leg sections comprises a series of holes in the tubular upper leg section, the lower leg extension fitting into the upper leg section, and a spring loaded nipple in the lower leg extension, biased outwardly from the surface of the lower leg extension, so that the spring biased nipple can be located at an appropriate one of said series of holes in the tubular upper leg section and allowed to pop outwardly into the hole to lock the leg extension at the desired position.

5. The chair of claim 1, wherein the chair frame has a horizontal pivot rod connecting the seat and back, the pivot rod extending laterally outwardly from the chair frame and bearing against back sides of the rear upper leg sections so as to maintain the seat and back in an erected position.

6. The chair of claim 1, further including adjustable-length lateral braces, one extending between the two front lower leg extensions and one extending between the two rear lower leg extensions, for increasing stability when the legs are unequally extended on uneven terrain.

* * * * *